US010520846B2

(12) United States Patent
Tsujimoto et al.

(10) Patent No.: US 10,520,846 B2
(45) Date of Patent: Dec. 31, 2019

(54) IMAGE FORMATION APPARATUS

(71) Applicant: KONICA MINOLTA, INC., Tokyo (JP)

(72) Inventors: Takahiro Tsujimoto, Toyokawa (JP); Natsuyo Higashi, Toyokawa (JP); Hirotada Seki, Toyokawa (JP); Hiroshi Eguchi, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/966,380

(22) Filed: Apr. 30, 2018

(65) Prior Publication Data

US 2018/0321610 A1 Nov. 8, 2018

(30) Foreign Application Priority Data

May 2, 2017 (JP) ..... 2017-091844

(51) Int. Cl.

*G03G 15/02* (2006.01)
*G03G 15/00* (2006.01)
*G03G 21/08* (2006.01)

(52) U.S. Cl.

CPC ..... *G03G 15/0266* (2013.01); *G03G 15/0216* (2013.01); *G03G 15/5004* (2013.01); *G03G 21/08* (2013.01); *G03G 2215/025* (2013.01)

(58) Field of Classification Search

CPC ..... G03G 15/0283
See application file for complete search history.

(56) References Cited

U.S. PATENT DOCUMENTS 5,774,769 A * 6/1998 Chigono ..... G03G 15/0241 361/225
6,909,859 B2 * 6/2005 Nakamura ..... G03G 15/0266 399/175
7,639,960 B2 * 12/2009 Kobashi ..... G03G 15/0266 399/174
7,684,714 B2 * 3/2010 Kamoshida ..... G03G 15/0216 399/25

(Continued)

FOREIGN PATENT DOCUMENTS

JP 08-185017 A 7/1996
JP 2013231916 A * 11/2013

*Primary Examiner* — Clayton E. LaBalle
*Assistant Examiner* — Leon W Rhodes, Jr.
(74) *Attorney, Agent, or Firm* — Buchanan Ingersoll & Rooney PC

(57) ABSTRACT

An image formation apparatus includes an image carrier, a first charging member which abuts on the image carrier and charges the image carrier, a second charging member which abuts on the image carrier and charges the image carrier, the second charging member having such resistance characteristics as being less in variation with environmental variation than the first charging member, a power supply apparatus which can apply a voltage to each of the first and second charging members, and a control device which sets a voltage to be applied to the first charging member by the power supply apparatus based on a first amount of current which flows from the power supply apparatus through the first charging member to the image carrier and a second amount of current which flows to the image carrier through the second charging member.

9 Claims, 9 Drawing Sheets

(56) References Cited

U.S. PATENT DOCUMENTS

| | | | | |
|---|---|---|---|---|
| 8,229,311 | B2 * | 7/2012 | Yanagihara | G03G 15/1675 399/44 |
| 2002/0039497 | A1 * | 4/2002 | Yasuda | G03G 15/0216 399/89 |

* cited by examiner

IMAGE FORMATION APPARATUS

The entire disclosure of Japanese Patent Application No. 2017-091844 filed on May 2, 2017 is incorporated herein by reference in its entirety.

BACKGROUND

Technological Field

The present disclosure relates to an image formation apparatus and particularly to control of a charging apparatus.

Description of the Related Art

In general, an image formation apparatus (a printer, a copying machine, and a facsimile machine) making use of an electrophotographic process technique forms an electrostatic latent image by irradiating (exposing to light) a charged photoconductor with laser beams based on image data. Then, the electrostatic latent image is visualized by supplying toner from a development apparatus to the photoconductor on which the electrostatic latent image has been formed, and a toner image is thus formed. The toner image is directly or indirectly transferred to paper, and thereafter the toner image is fixed by heating and application of a pressure in a fixing nip. The toner image is thus formed on the paper.

In an image formation apparatus of this type, proper adjustment of a charge potential at which a charging apparatus charges a photoconductor has conventionally been demanded. The photoconductor, however, is not constant in film thickness. When the film thickness decreases, the charge potential varies and an image may be poor or a line may be thin.

Japanese Laid-Open Patent Publication No. 08-185017 has proposed a scheme of sensing a charge potential at a surface of a photoconductor, predicting production of a poor image, and setting a charge bias voltage.

SUMMARY

Though Japanese Laid-Open Patent Publication No. 08-185017 has proposed a scheme of calculating a charge potential based on an amount of current which flows to a charging roller as a scheme of sensing a charge potential of a photoconductor, resistance characteristics of the charging roller also vary with environmental variation.

Therefore, it has been difficult to accurately sense a charge potential and to set a proper charge bias voltage.

The present disclosure was made to solve the problem above and an object thereof is to provide an image formation apparatus which can set a proper charge bias voltage.

To achieve at least one of the abovementioned objects, according to an aspect of the present invention, an image formation apparatus reflecting one aspect of the present invention comprises an image carrier, a first charging member which abuts on the image carrier and charges the image carrier, a second charging member which abuts on the image carrier and charges the image carrier, the second charging member having such resistance characteristics as being less in variation with environmental variation than the first charging member, a power supply apparatus which can apply a voltage to each of the first and second charging members, and a control device which sets a voltage to be applied to the first charging member by the power supply apparatus based on a first amount of current which flows from the power supply apparatus through the first charging member to the image carrier and a second amount of current which flows to the image carrier through the second charging member.

Preferably, the control device calculates a resistance value of the first charging member based on subtraction of the first and second amounts of current and sets the voltage to be applied to the first charging member by the power supply apparatus based on a result of calculation.

Preferably, the control device sets a voltage resulting from addition of a voltage decrement caused by the first charging member based on the calculated resistance value to a prescribed voltage as the voltage to be applied to the first charging member.

Preferably, a switch which allows electrical connection of at least one of the first and second charging members to the power supply apparatus is further provided.

Preferably, the control device sets the voltage to be applied to the first charging member by the power supply apparatus based on the first amount of current which flows from the power supply apparatus through the first charging member to the image carrier and the second amount of current which flows to the image carrier through the second charging member during a period for stabilization of an image.

Preferably, the power supply apparatus applies an alternating-current (AC) or direct-current (DC) voltage to the first and second charging members.

Preferably, the second charging member includes at least any one of a metal member, a conductive guide member, and a brush.

Preferably, the metal member corresponds to a metal roller.

Preferably, a prescribed resistor connected between the power supply apparatus and the second charging member is further provided.

The foregoing and other objects, features, aspects and advantages of the present invention will become more apparent from the following detailed description of the present invention when taken in conjunction with the accompanying drawings.

The foregoing and other objects, features, aspects and advantages of this invention will become more apparent from the following detailed description of the this invention when taken in conjunction with the accompanying drawings.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
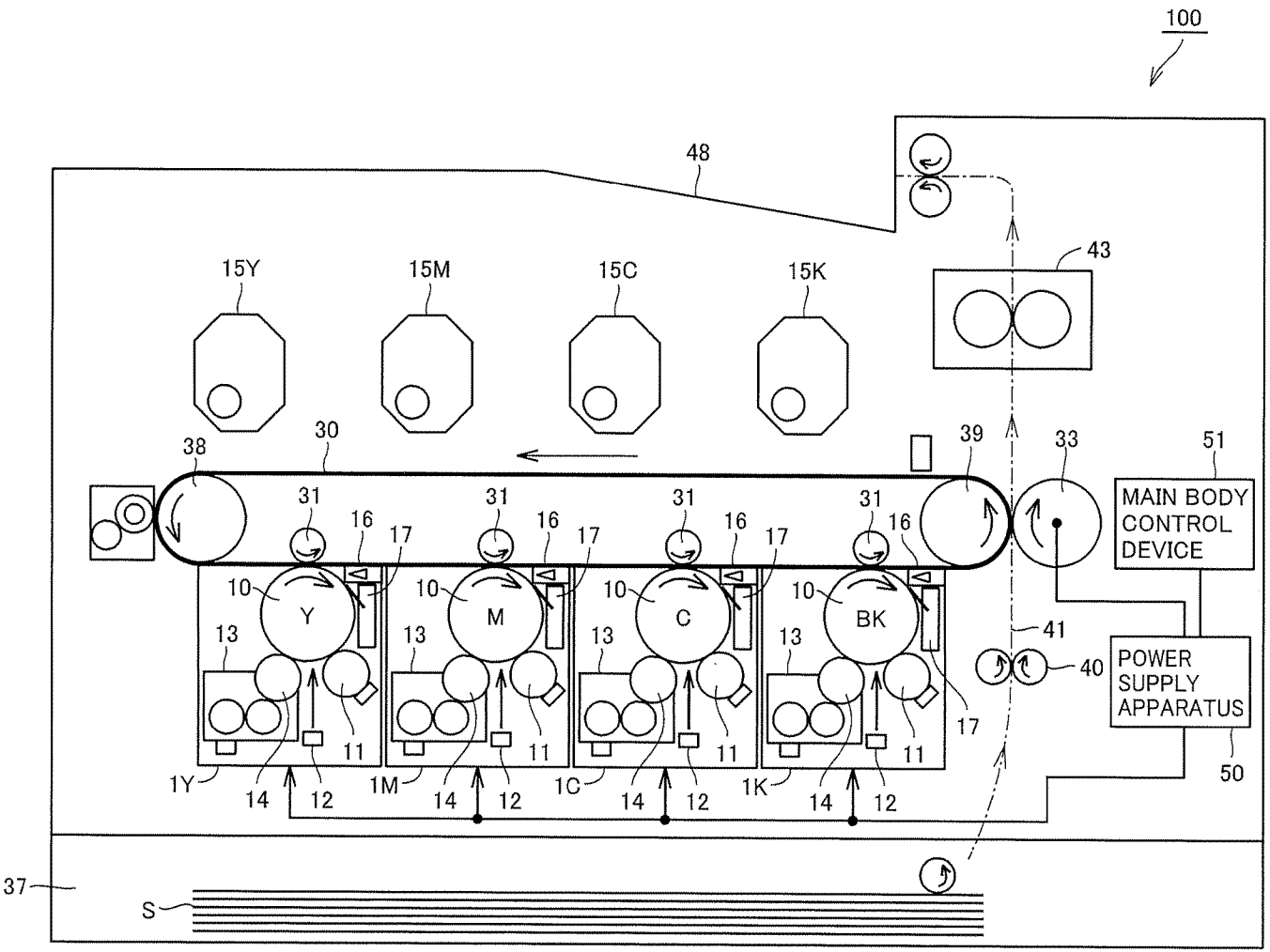
FIG. 1 is a diagram showing one example of an internal structure of an image formation apparatus 100 based on an embodiment.

Hereinafter, one or more embodiments of the present invention will be described with reference to the drawings. However, the scope of the invention is not limited to the disclosed embodiments.

Each embodiment will be described below with reference to the drawings. The same elements and components in the description below have the same reference characters allotted and their labels and functions are also the same. Therefore, detailed description thereof will not be repeated. Each embodiment and each modification described below may selectively be combined as appropriate.

An example in which a power supply apparatus is mounted on an image formation apparatus will be described in an embodiment below. Examples of the image formation apparatus include an MFP, a printer, a copying machine, or a facsimile machine.

[Internal Configuration of Image Formation Apparatus]

FIG. 1 is a diagram showing one example of an internal structure of an image formation apparatus 100 based on an embodiment.

Image formation apparatus 100 on which a power supply apparatus 50 is mounted will be described with reference to FIG. 1.

FIG. 1 shows image formation apparatus 100 as a color printer. Though image formation apparatus 100 as the color printer will be described below, image formation apparatus 100 is not limited to the color printer. For example, image formation apparatus 100 may be a multi-functional peripheral (MFP).

Image formation apparatus 100 has a monochrome printing mode in which an image is formed by using only black and a color printing mode in which an image is formed by using yellow, magenta, cyan, and black.

Image formation apparatus 100 includes image formation units 1Y, 1M, 1C, and 1K, an intermediate transfer belt 30, a primary transfer roller 31, a secondary transfer roller 33, a cassette 37, a driven roller 38, a drive roller 39, a timing roller 40, a fixation apparatus 43, and a power supply apparatus 50.

Image formation units 1Y, 1M, 1C, and 1K are sequentially aligned along intermediate transfer belt 30. Image formation unit 1Y forms a toner image of yellow (Y) upon receiving supply of toner from a toner bottle 15Y. Image formation unit 1M forms a toner image of magenta (M) upon receiving supply of toner from a toner bottle 15M. Image formation unit 1C forms a toner image of cyan (C) upon receiving supply of toner from a toner bottle 15C. Image formation unit 1K forms a toner image of black (BK) upon receiving supply of toner from a toner bottle 15K.

Image formation units 1Y, 1M, 1C, and 1K are arranged sequentially in a direction of rotation of intermediate transfer belt 30 along intermediate transfer belt 30. Each of image formation units 1Y, 1M, 1C, and 1K includes a photoconductor 10, a charging apparatus 11, an exposure apparatus 12, a development apparatus 13, a deelectrifying apparatus 16, and a cleaning apparatus 17.

Charging apparatus 11 evenly charges a surface of photoconductor 10. Exposure apparatus 12 irradiates photoconductor 10 with laser beams in response to a control signal from a main body control device 51 which will be described later and exposes the surface of photoconductor 10 in accordance with an input image pattern. An electrostatic latent image in accordance with an input image is thus formed on photoconductor 10.

Development apparatus 13 applies a development bias to a development roller 14 while it rotates development roller 14, to thereby attach toner onto a surface of development roller 14. The toner is thus transferred from development roller 14 to photoconductor 10 and a toner image in accordance with the electrostatic latent image is developed on the surface of photoconductor 10.

Photoconductor 10 and intermediate transfer belt 30 are in contact with each other at a portion where primary transfer roller 31 is provided. Primary transfer roller 31 is configured to be rotatable. A transfer voltage opposite in polarity to the toner image is applied to primary transfer roller 31 so that the toner image is transferred from photoconductor 10 to intermediate transfer belt 30.

In the color printing mode, the toner image of yellow (Y), the toner image of magenta (M), the toner image of cyan (C), and the toner image of black (BK) are successively layered and transferred from photoconductor 10 to intermediate transfer belt 30. The color toner image is thus formed on intermediate transfer belt 30. In the monochrome printing mode, the toner image of black (BK) is transferred from photoconductor 10 to intermediate transfer belt 30.

Intermediate transfer belt 30 is looped around driven roller 38 and drive roller 39. Drive roller 39 is rotationally driven, for example, by a motor (not shown). Intermediate transfer belt 30 and driven roller 38 rotate in coordination with drive roller 39. A toner image on intermediate transfer belt 30 is thus transported to secondary transfer roller 33.

Deelectrifying apparatus 16 deelectrifies charged toner which adheres to the surface of photoconductor 10. By deelectrifying charges of charged toner, recovery of toner by cleaning apparatus 17 which will be described later is facilitated.

Cleaning apparatus 17 is pressed against photoconductor 10 as being in contact therewith. Cleaning apparatus 17 recovers toner which remains on the surface of photoconductor 10 after transfer of the toner image.

Paper S is set in cassette 37. Paper S is sent from cassette 37 to secondary transfer roller 33 one by one along a transportation path 41 by timing roller 40. Secondary transfer roller 33 applies a transfer voltage opposite in polarity to the toner image to transported paper S. The toner image is thus attracted from intermediate transfer belt 30 to secondary transfer roller 33 and the toner image on intermediate transfer belt 30 is transferred to paper S. Timing of transportation of paper S to secondary transfer roller 33 is adjusted by timing roller 40 in accordance with a position of the toner image on intermediate transfer belt 30. Owing to timing roller 40, the toner image on intermediate transfer belt 30 is transferred to an appropriate position on paper S.

Fixation apparatus 43 pressurizes and heats paper S which passes therethrough. The toner image formed on paper S is thus fixed onto paper S. Thereafter, paper S is ejected onto a tray 48.

Power supply apparatus 50 supplies various necessary voltages, for example, to each apparatus in image formation apparatus 100. Details of power supply apparatus 50 will be described later. In the present example, power supply apparatus 50 supplies a voltage of 24 V by way of example to an apparatus belonging to a drive system in image formation apparatus 100. Power supply apparatus 50 supplies a voltage of 5 V by way of example to an apparatus belonging to a control system in image formation apparatus 100.

[Hardware Configuration of Image Formation Apparatus]

Figure 2:
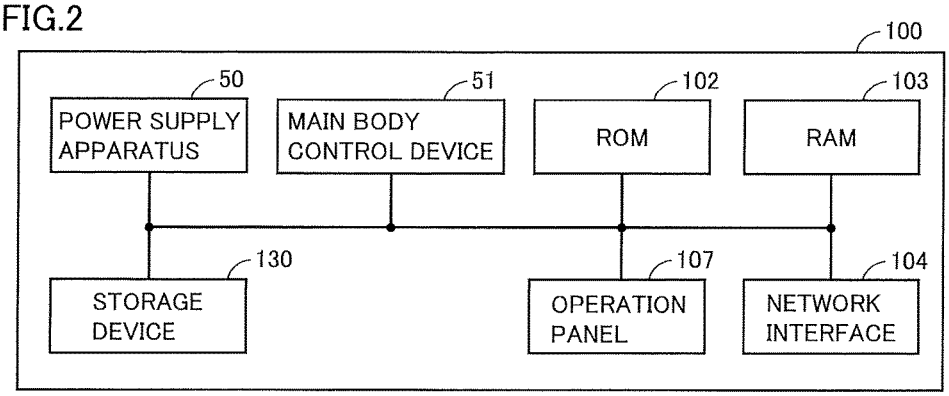
FIG. 2 is a block diagram showing a main hardware configuration of image formation apparatus 100.

FIG. 2 is a block diagram showing a main hardware configuration of image formation apparatus 100. One example of the hardware configuration of image formation apparatus 100 will be described with reference to FIG. 2.

As shown in FIG. 2, image formation apparatus 100 includes power supply apparatus 50, main body control device 51, a read only memory (ROM) 102, a random access memory (RAM) 103, a network interface 104, an operation panel 107, and a storage device 130.

Main body control device 51 is implemented, for example, by at least one integrated circuit. The integrated circuit is implemented, for example, by at least one CPU, at least one DSP, at least one application specific integrated circuit (ASIC), at least one field programmable gate array (FPGA), or combination thereof.

Main body control device 51 controls both of power supply apparatus 50 and image formation apparatus 100. Main body control device 51 is shared by power supply apparatus 50 and image formation apparatus 100. Main body control device 51 may be configured separately from or integrally with power supply apparatus 50. When main body control device 51 is configured separately from power supply apparatus 50, power supply apparatus 50 is simplified in configuration.

Main body control device 51 selects any of a monochrome printing mode and a color printing mode in accordance with information input to operation panel 107 and controls power supply apparatus 50 and image formation apparatus 100 in accordance with the selected mode. Main body control device 51 outputs a selected mode identification signal indicating the selected mode to power supply apparatus 50.

Main body control device 51 controls operations of image formation apparatus 100 by executing a control program for power supply apparatus 50 or image formation apparatus 100.

Main body control device 51 reads a control program from storage device 130 to ROM 102 based on acceptance of an instruction to execute the control program. RAM 103 functions as a working memory and temporarily stores various types of data necessary for execution of the control program.

Main body control device 51 performs prescribed processing for power supply apparatus 50 based on an instruction to execute the control program. By way of example, main body control device 51 carries out control to switch from a normal mode to a power saving mode in response to an instruction to switch to the power saving mode given by a user through operation panel 107.

An antenna (not shown) or the like is connected to network interface 104. Image formation apparatus 100 exchanges data with external communication equipment through the antenna. External communication equipment includes, for example, a portable communication terminal such as a smartphone and a server. Image formation apparatus 100 may be configured to be able to download a control program from a server through the antenna.

Operation panel 107 is implemented by a display and a touch panel. The display and the touch panel are layered on each other and operation panel 107 accepts, for example, a printing operation or a scanning operation onto image formation apparatus 100.

Storage device 130 is, for example, a storage medium such as a hard disk or an external storage device. Storage device 130 stores a control program for image formation apparatus 100. A location where the control program is stored is not limited to storage device 130, and the control program may be stored in a storage area of power supply apparatus 50, a storage area of main body control device 51 (for example, a cache), ROM 102, RAM 103, or external equipment (for example, a server). The control program may be provided not as a program alone but as being incorporated as a part of any program. In this case, the control process according to the present embodiment is implemented in cooperation with any program. Even a program not including some modules as such does not depart from the gist of the control program according to the present embodiment. Some or all of functions provided by the control program may be implemented by dedicated hardware. Image formation apparatus 100 may be configured in such a form as what is called a cloud service in which at least one server implements some of the process of the control program.

[Configuration of Charging Apparatus 11]

Figure 3:
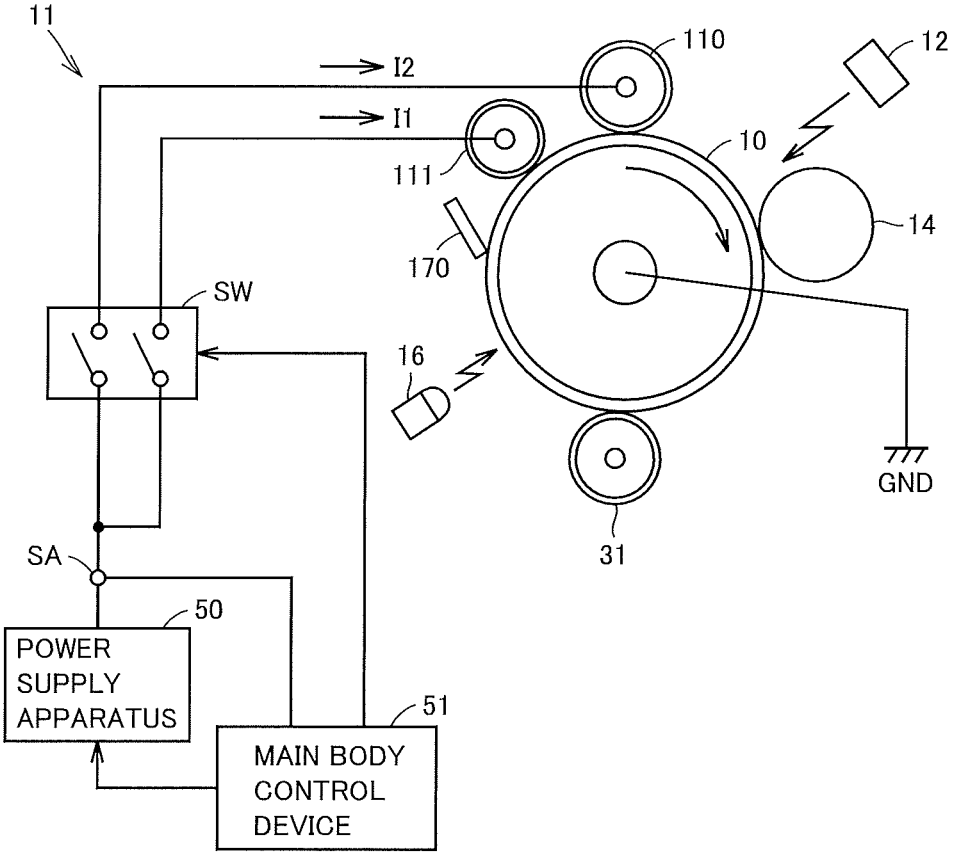
FIG. 3 is a diagram illustrating a charging apparatus 11 based on the embodiment.

FIG. 3 is a diagram illustrating charging apparatus 11 based on the embodiment.

FIG. 3 shows arrangement of charging apparatus 11, exposure apparatus 12, development roller 14 of development apparatus 13, primary transfer roller 31, deelectrifying apparatus 16, and a cleaning blade 170 of cleaning apparatus 17 around photoconductor 10.

Power supply apparatus 50 is connected to charging apparatus 11 and supplies a charge bias voltage.

Charging apparatus 11 includes a charging roller 110 which abuts on photoconductor 10, a charging roller 111 which is provided separately from charging roller 110 and abuts on photoconductor 10, a switch circuit SW, and a current sensor SA.

Switch circuit SW switches a voltage supply path in response to an instruction from main body control device 51. Specifically, switch circuit SW allows connection among power supply apparatus 50, any one of charging rollers 110 and 111, and power supply apparatus 50 in response to an instruction from main body control device 51.

Charging roller 111 has such resistance characteristics as being less in variation with environmental variation than charging roller 110. Specifically, a metal roller sufficiently lower in resistance value than charging roller 110 can be employed as charging roller 111.

Current sensor SA senses a current which flows through a voltage supply path and outputs the current value to main body control device 51.

Main body control device 51 controls a charge bias voltage to be output from power supply apparatus 50 based on the current sensed by current sensor SA.

Charging roller 110 evenly charges the surface of photoconductor 10. Exposure apparatus 12 forms an electrostatic latent image on photoconductor 10 by emitting laser beams. Development apparatus 13 places toner in accordance with the electrostatic latent image. After an image is transferred to intermediate transfer belt 30 as a result of transfer by primary transfer roller 31, a remaining potential on photoconductor 10 is removed by deelectrifying apparatus 16 and remaining toner is recovered by cleaning blade 170.

Figure 4:
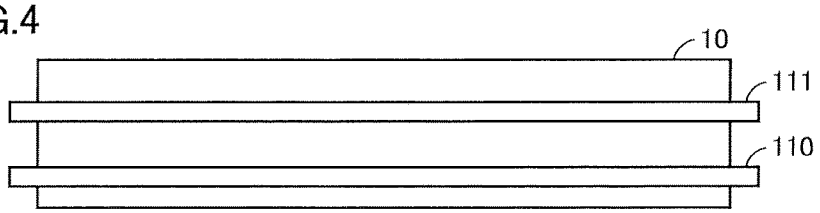
FIG. 4 is a diagram illustrating charging rollers 110 and 111 based on the embodiment.

FIG. 4 is a diagram illustrating charging rollers 110 and 111 based on the embodiment.

As shown in FIG. 4, two charging rollers 110 and 111 for photoconductor 10 are arranged in a longitudinal direction and abuts on photoconductor 10.

In the present example, charging rollers 110 and 111 for photoconductor 10 are viewed from above.

[Setting of Charge Bias Voltage]

Setting of a charge bias voltage will now be described.

Charging apparatus 11 applies a charge bias voltage resulting from superimposition of an AC voltage on a DC voltage such that the surface of photoconductor 10 is uniformly charged.

Figure 5:
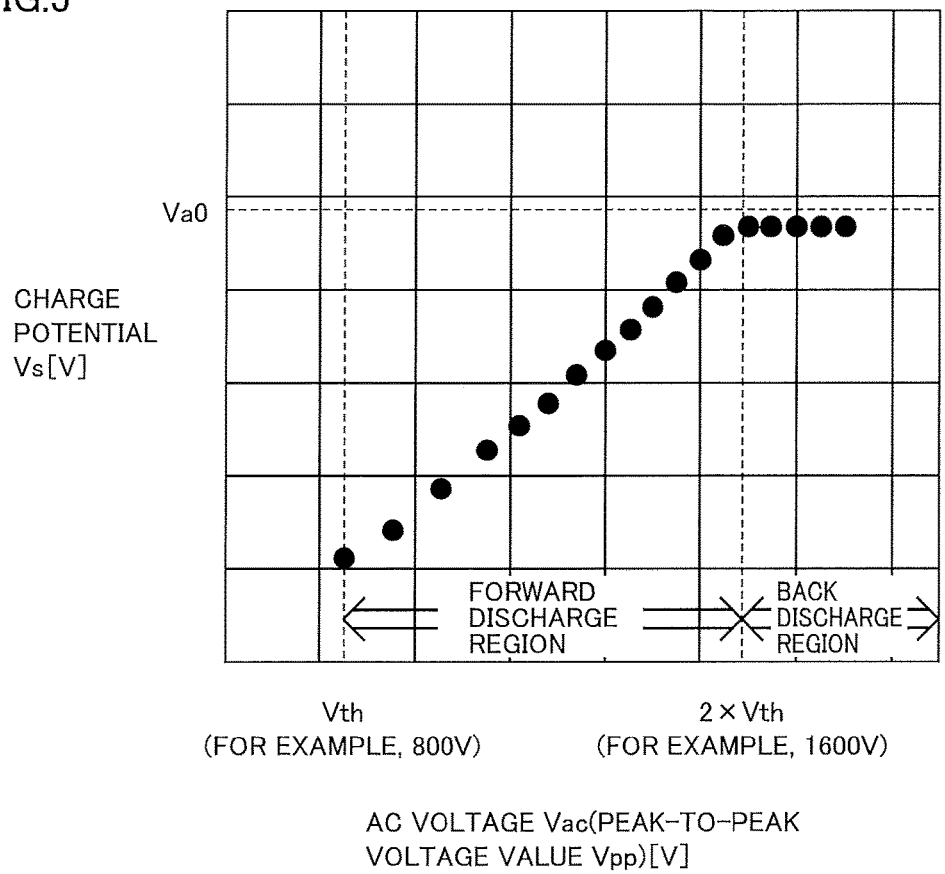
FIG. 5 is a diagram illustrating a charge potential Vs of a photoconductor 10 with respect to a peak-to-peak voltage value Vpp of an AC voltage Vac.

FIG. 5 is a diagram illustrating a charge potential Vs of photoconductor 10 with respect to a peak-to-peak voltage value Vpp of an AC voltage Vac.

As shown in FIG. 5, so long as peak-to-peak voltage value Vpp is within a range from a charging start voltage value Vth to a voltage value 2×Vth twice as large as that, charge potential Vs is approximately in proportion to AC voltage Vac.

Charging start voltage value Vth is a voltage value at which charging of photoconductor 10 with a DC voltage Vdc is started, and it is determined by various characteristics of photoconductor 10.

FIG. 5 shows an example in which Vth is set to 800 V and 2×Vth is 1600 V.

Above 2×Vth, charge potential Vs is saturated and remains at an approximately constant charge potential Va0. Therefore, in order to make charge potential Vs uniform, a charge bias voltage resulting from superimposition of AC voltage Vac of which peak-to-peak voltage value Vpp exceeds 2×Vth should be applied to charging roller 110.

Charge potential Va0 at that time is dependent on DC voltage Vdc included in a charging voltage.

In the image formation apparatus, regardless of influence by an environment or manufacturing variation in resistance value of the charging roller, an amount of discharge of charging apparatus 11 should always be constant so that photoconductor 10 uniformly is charged without causing such problems as deterioration of photoconductor 10 or production of a poor image. Therefore, the image formation apparatus detects an AC current which flows from charging apparatus 11 through photoconductor 10 and makes adjustment based on a result of detection.

Specifically, values of AC currents which flow to charging roller 110 at the tune when a plurality of AC voltages Vac which are lower than 2×Vth and different in peak-to-peak voltage value Vpp from one another are successively applied while no paper is passing are measured with current sensor SA.

Similarly, values of AC currents at the time of application of a plurality of AC voltages Vac which are not lower than 2×Vth and are different in peak-to-peak voltage value Vpp from one another are also measured with current sensor SA.

Figure 6:
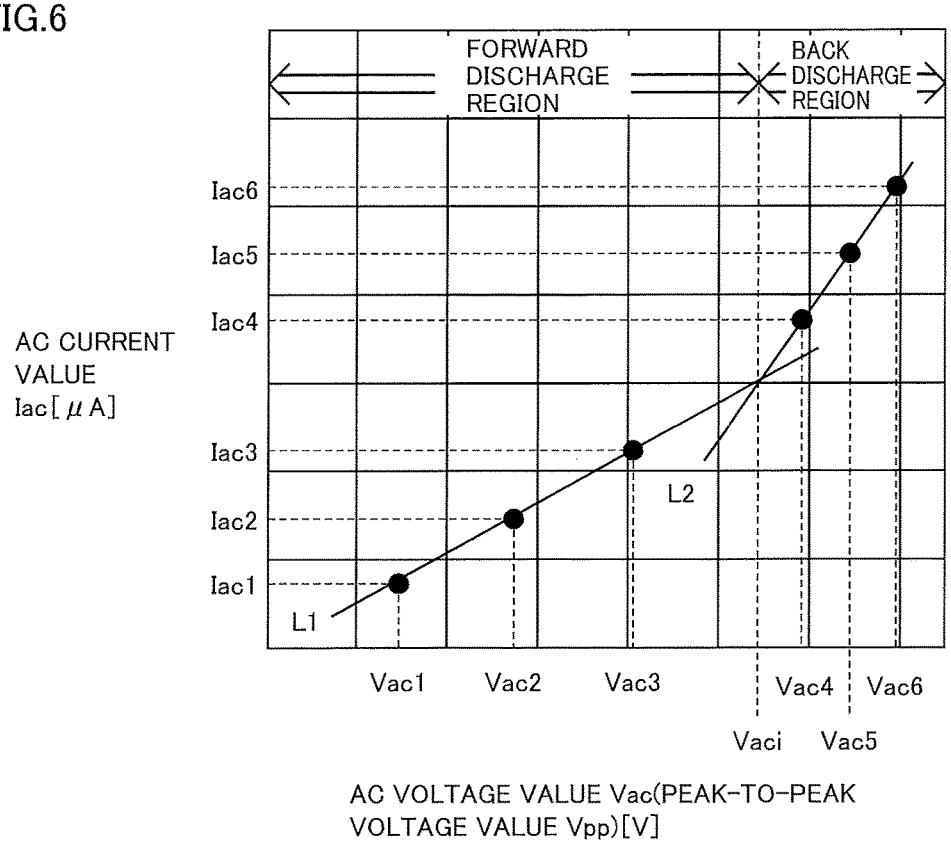
FIG. 6 is a diagram illustrating AC current values when a plurality of AC voltages Vac are applied.

FIG. 6 is a diagram illustrating AC current values when a plurality of AC voltages Vac are applied.

In the present example, a region where peak-to-peak voltage value Vpp is lower than 2×Vth is defined as a forward discharge region where only transfer of charges from charging means to a photoconductor drum (that is, transfer of charges in a single direction) takes place.

A region equal to or higher than 2×Vth is defined as a back discharge region where bidirectional transfer of charges between photoconductor 10 and the charging apparatus alternately takes place.

As shown in FIG. 6, values of AC currents Iac1 to Iac3 which flow from charging apparatus 11 when AC voltages Vac1 to Vac 3 in the forward discharge region are superimposed are obtained, and thereafter values of AC currents Iac1 to Iac3 are subjected to linear approximation to thereby obtain a characteristic line L1 of the AC current values with respect to the AC voltages in the forward discharge region.

Similarly, a characteristic line L2 of values of AC currents with respect to AC voltages in the back discharge region is also obtained.

An intersection between characteristic lines L1 and L2 is determined as a value of an AC voltage Vaci to be superimposed in a printing process.

A process of such a type is performed, for example, in control for stabilizing an image during warm-up, forced replenishment with toner, or adjustment of a toner to carrier ratio (TCR).

Figure 7:
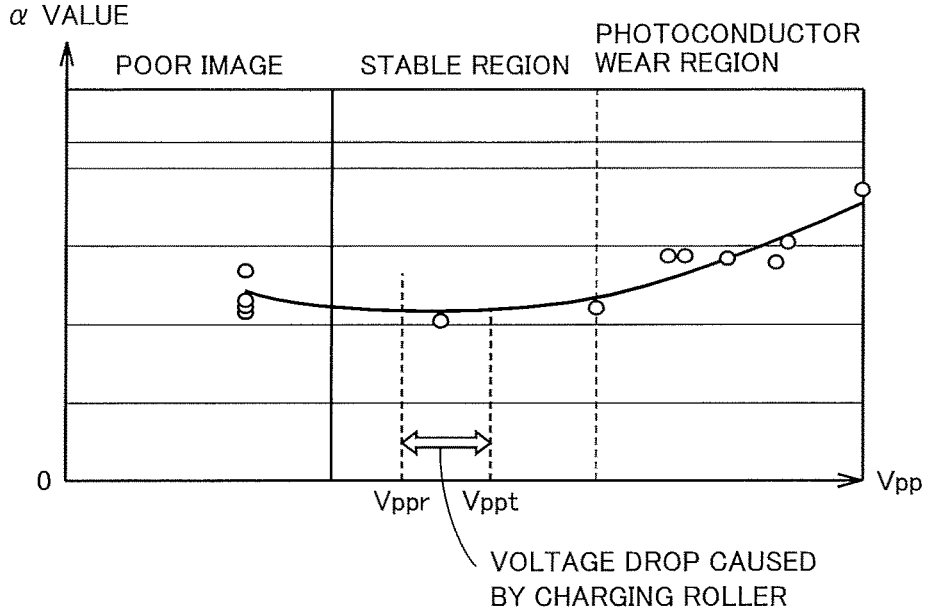
FIG. 7 is a diagram illustrating relation between peak-to-peak voltage value Vpp and an α value based on the embodiment.

FIG. 7 is a diagram illustrating relation between peak-to-peak voltage value Vpp and an α value based on the embodiment.

In FIG. 7, an α value (μm/100 k rotations) represents an amount of abrasion of a photoconductor layer of photoconductor 10 per one hundred thousand rotations. Three regions are shown by way of example. Specifically, a stable region, a photoconductor wear region, and a poor image region are shown. In the present example, a peak-to-peak voltage value Vppt defined as a target value is within the stable region.

When a voltage higher than peak-to-peak voltage value Vppt is applied and the peak-to-peak voltage value enters the photoconductor wear region, a degree of wear of photoconductor 10 increases.

On the other hand, when a voltage lower than peak-to-peak voltage value Vppt is applied and the peak-to-peak voltage value enters the poor image region, a poor image is produced.

Therefore, the peak-to-peak voltage value should be maintained in the stable region.

Resistance characteristics of charging roller 110, however, also vary due to manufacturing variation or environmental variation. Therefore, due to variation in resistance characteristics, a value for the peak-to-peak voltage actually applied to photoconductor 10 may be set to be lower than peak-to-peak voltage value Vppt defined as the target value.

Specifically, due to a voltage drop in charging roller 110, a peak-to-peak voltage value Vppr may be applied to photoconductor 10.

The voltage drop significantly varies with environmental variation. Therefore, unless a peak-to-peak voltage is corrected, a poor image may be produced.

When a relatively high peak-to-peak voltage is set, a degree of wear of photoconductor 10 also increases.

In the present embodiment, a voltage drop in charging roller 110 is accurately detected so that a proper charge bias voltage is set.

Specifically, charging roller 111 different from charging roller 110 is provided, a current which flows to each of them is detected to calculate a voltage drop, and a charge bias voltage is set.

In FIG. 3, switch circuit SW sets a path through which a prescribed charge bias voltage is supplied from power supply apparatus 50 to charging roller 110 in response to an instruction from main body control device 51. In this case, in the present example, a current I2 flows to charging roller 110. Switch circuit SW sets a path through which a prescribed charge bias voltage is supplied from power supply apparatus 50 to charging roller 111 in response to an instruction from main body control device 51. In this case, in the present example, a current I1 flows to charging roller 111.

Currents I1 and I2 are detected by current sensor SA.

Main body control device 51 can calculate a resistance value Rx of charging roller 110 based on a prescribed charge bias voltage V/(I1−I2). Though a resistance value of charging roller 111 is not included in calculation assuming that the resistance value of charging roller 111 is sufficiently smaller than a resistance value of charging roller 110, the resistance value of charging roller 111 may be included in calculation.

Then, the voltage drop in charging roller 110 can be calculated based on the calculated resistance value of charging roller 110 and current I2.

Therefore, main body control device 51 can set, in consideration of the voltage drop in charging roller 110 from target value Vppt, a charge bias voltage resulting from addition of that voltage decrement.

Specifically, main body control device 51 sets the charge bias voltage based on target value Vppt+current I2×calculated resistance value Rx of charging roller 110. Main body control device 51 instructs power supply apparatus 50 to output the charge bias voltage.

A proper charge bias voltage in the stable region is thus set so that production of a poor image is suppressed and wear of photoconductor 10 can also be suppressed. Timing to replace photoconductor 10 can thus be set to be within a proper period and photoconductor 10 can have a longer lifetime.

A prescribed charge bias voltage V in the present example in calculation of a resistance value of charging roller 110 may be the same as or different from a voltage used in a printing process. An AC voltage or a DC voltage may be applied.

The charge bias voltage can be set in control for stabilizing an image during warm-up, forced replenishment with toner, or adjustment of a toner to carrier ratio (TCR) as described above.

(First Modification)

Figure 8:
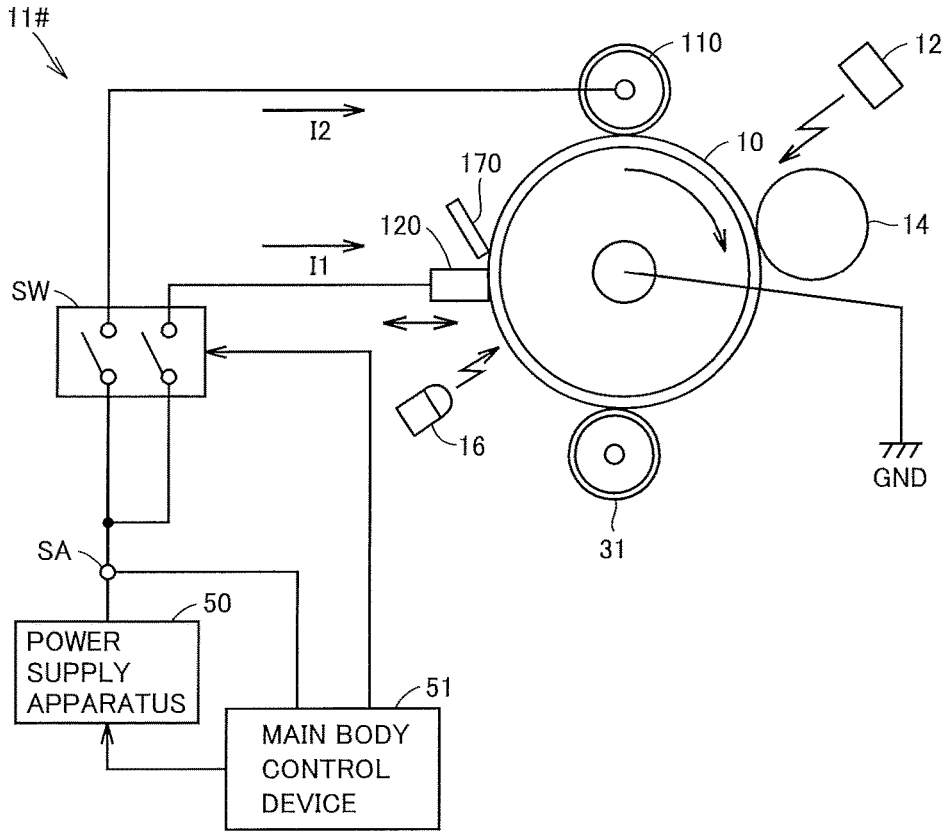
FIG. 8 is a diagram illustrating a charging apparatus 11# based on a first modification of the embodiment.

FIG. 8 is a diagram illustrating a charging apparatus 11# based on a first modification of the embodiment.

In FIG. 8, charging apparatus 11# different in configuration in FIG. 3 is provided.

Charging apparatus 11# includes a movable conductive member 120 instead of charging roller 111.

Switch circuit SW connects power supply apparatus 50, any one of charging roller 110 and conductive member 120, and power supply apparatus 50 in response to an instruction from main body control device 51.

Conductive member 120 is movably provided and provided to be able to be in/out of contact with photoconductor 10.

In the present example as well, a voltage drop in charging roller 110 is accurately detected so that a proper charge bias voltage is set.

Specifically, switch circuit SW sets a path through which a prescribed charge bias voltage is supplied from power supply apparatus 50 to charging roller 110 in response to an instruction from main body control device 51. In this case, in the present example, current I2 flows to charging roller 110. Switch circuit SW sets a path through which a prescribed charge bias voltage is supplied from power supply apparatus 50 to conductive member 120 in response to an instruction from main body control device 51. In this case, in the present example, current I1 flows to conductive member 120.

Currents I1 and I2 are detected by current sensor SA.

A resistance value of charging roller 110 can be calculated based on prescribed charge bias voltage V/(I1−I2).

Then, the voltage drop in charging roller 110 can be calculated based on the calculated resistance value of charging roller 110 and current I2.

Therefore, in consideration of the voltage drop in charging roller 110 from target value Vppt, a charge bias voltage resulting from addition of that voltage decrement can be set.

Specifically, main body control device 51 sets the charge bias voltage based on target value Vppt+current I2×the calculated resistance value of charging roller 110. Main body control device 51 instructs power supply apparatus 50 to output the charge bias voltage.

A proper charge bias voltage in the stable region is thus set so that production of a poor image is suppressed and wear of photoconductor 10 can also be suppressed.

Prescribed charge bias voltage V in the present example in calculation of a resistance value of charging roller 110 may be the same as or different from a voltage used in a printing process. An AC voltage or a DC voltage may be applied.

By providing movable conductive member 120 not steadily in contact with photoconductor 10, wear of photoconductor 10 can be suppressed. Without being limited to charging roller 111 and conductive member 120, a metal brush or a conductive guide member can also be employed.

(Second Modification)

Figure 9:
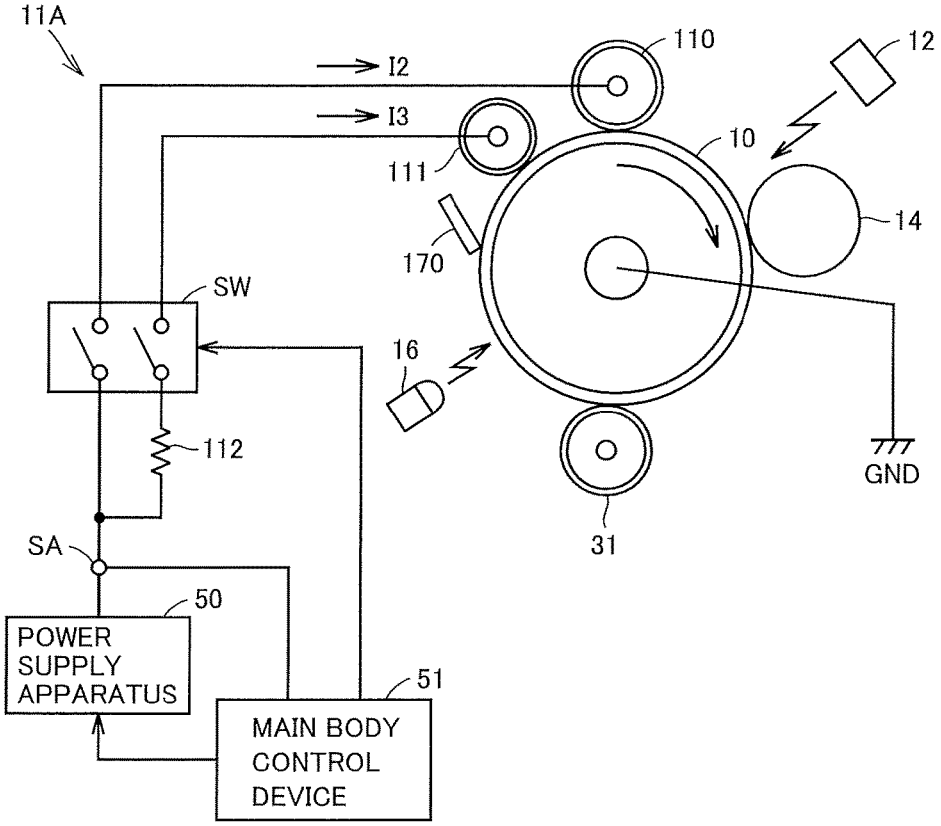
FIG. 9 is a diagram illustrating a charging apparatus 11A based on a second modification of the embodiment.

FIG. 9 is a diagram illustrating a charging apparatus 11A based on a second modification of the embodiment.

In FIG. 9, charging apparatus 11A different in configuration in FIG. 3 is provided.

Charging apparatus 11A in which a resistor 112 is connected in series in a voltage supply path for charging roller 111 is shown. According to the configuration, an amount of current which flows through the voltage supply path can be decreased.

Switch circuit SW connects power supply apparatus 50, any one of charging rollers 110 and 111, and power supply apparatus 50 in response to an instruction from main body control device 51.

In the present example as well, a voltage drop in charging roller 110 is accurately detected so that a proper charge bias voltage is set.

Specifically, switch circuit SW sets a path through which a prescribed charge bias voltage is supplied from power supply apparatus 50 to charging roller 110 in response to an instruction from main body control device 51. In this case, in the present example, current I2 flows to charging roller 110. Switch circuit SW sets a path through which a prescribed charge bias voltage is supplied from power supply apparatus 50 to charging roller 111 in response to an instruction from main body control device 51. In this case, in the present example, a current I3 flows to charging roller 111.

Currents I2 and I3 are detected by current sensor SA.

Photoconductor 10 has a resistance value Rp and resistor 112 has a resistance value Ry. An example in which a resistance value of charging roller 111 is not included in calculation assuming that it is sufficiently lower than that of resistor 112 will be described.

Resistance value Rp of photoconductor 10 is calculated as [V−(I3×Ry)]/I3.

Resistance value Rx of charging roller 110 is thus calculated as [V−(I2×Rp)]/I2.

Then, the voltage drop in charging roller 110 can be calculated based on the calculated resistance value of charging roller 110 and current I2.

Therefore, in consideration of the voltage drop in charging roller 110 from target value Vppt, a charge bias voltage resulting from addition of that voltage decrement can be set.

Specifically, main body control device 51 sets the charge bias voltage based on target value Vppt+current I2×calculated resistance value Rx of charging roller 110. Main body control device 51 instructs power supply apparatus 50 to output the charge bias voltage.

A proper charge bias voltage in the stable region is thus set so that production of a poor image is suppressed and wear of photoconductor 10 can also be suppressed.

Prescribed charge bias voltage V in the present example in calculation of a resistance value of charging roller 110 may be the same as or different from a voltage used in a printing process. An AC voltage or a DC voltage may be applied.

In the present example, power consumption can be reduced by decreasing an amount of current which flows through the path for supply of a voltage to charging roller 111 by providing resistor 112.

Though an example in which a power supply apparatus is mainly used in an image formation apparatus has been described in the present example, a scheme can generally be used also for other applications without being particularly limited to the image formation apparatus.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image formation apparatus comprising:

an image carrier;

a first charging member which abuts on the image carrier and charges the image carrier;

a second charging member which abuts on the image carrier and charges the image carrier, the second charging member having such resistance characteristics as being less in variation with environmental variation than the first charging member;

a power supply apparatus which can apply a voltage to each of the first and second charging members; and a control device which calculates a resistance of said first charging member based on a first amount of current which flows from the power supply apparatus through the first charging member to the image carrier and a second amount of current which flows to the image carrier through the second charging member, and sets a voltage to be applied to the first charging member by the power supply apparatus based on the calculated result.

2. The image formation apparatus according to claim 1, wherein the control device calculates a resistance value of the first charging member based on subtraction of the first and second amounts of current and sets the voltage to be applied to the first charging member by the power supply apparatus based on a result of calculation.

3. The image formation apparatus according to claim 2, wherein the control device sets a voltage resulting from addition of a voltage decrement caused by the first charging member based on the calculated resistance value to a prescribed voltage as the voltage to be applied to the first charging member.

4. The image formation apparatus according to claim 1, the image formation apparatus further comprising a switch which allows electrical connection of at least one of the first and second charging members to the power supply apparatus.

5. The image formation apparatus according to claim 1, wherein the control device sets the voltage to be applied to the first charging member by the power supply apparatus based on the first amount of current which flows from the power supply apparatus through the first charging member to the image carrier and the second amount of current which flows to the image carrier through the second charging member during a period for stabilization of an image.

6. The image formation apparatus according to claim 1, wherein the power supply apparatus applies an alternating-current or direct-current voltage to the first and second charging members.

7. The image formation apparatus according to claim 1, wherein the second charging member includes at least any one of a metal member, a conductive guide member, and a brush.

8. The image formation apparatus according to claim 7, wherein the metal member corresponds to a metal roller.

9. The image formation apparatus according to claim 1, the image formation apparatus further comprising a prescribed resistor connected between the power supply apparatus and the second charging member.

* * * * *